US011787610B2

(12) United States Patent
Chao et al.

(10) Patent No.: US 11,787,610 B2
(45) Date of Patent: Oct. 17, 2023

(54) CHILD-PROOF CONTAINER

(71) Applicant: Zenpack, Sunnyvale, CA (US)

(72) Inventors: Tso Hua Chao, Sunnyvale, CA (US); Dominic DiCarlo, Sunnyvale, CA (US)

(73) Assignee: ZENPACK, Sunnyvale, CA (US)

( * ) Notice: Subject to any disclaimer, the term of this patent is extended or adjusted under 35 U.S.C. 154(b) by 0 days.

(21) Appl. No.: 17/515,169

(22) Filed: Oct. 29, 2021

(65) Prior Publication Data

US 2022/0135291 A1 May 5, 2022

Related U.S. Application Data

(60) Provisional application No. 63/110,244, filed on Nov. 5, 2020.

(51) Int. Cl.
*B65D 50/04* (2006.01)
*B65D 5/38* (2006.01)

(52) U.S. Cl.
CPC ..... *B65D 50/045* (2013.01); *B65D 5/38* (2013.01); *B65D 2215/02* (2013.01)

(58) Field of Classification Search
CPC .... B65D 5/38; B65D 2215/02; B65D 77/042; B65D 77/0433; B65D 77/0453; B65D 77/046; B65D 77/0413; B65D 7/10; B65D 9/08; B65D 11/12; B65D 2583/0468
USPC ..... 220/345.3, 345.2, 281; 206/1.5
See application file for complete search history.

(56) References Cited

U.S. PATENT DOCUMENTS

| | | | | |
|---|---|---|---|---|
| 2,077,595 | A * | 4/1937 | Swiss | B65D 5/62 426/94 |
| 5,275,291 | A * | 1/1994 | Sledge | B65D 83/04 220/348 |
| 5,351,646 | A | 10/1994 | Zoroufy | |
| 10,730,671 | B2 * | 8/2020 | Drosos | B65D 50/066 |
| 2008/0156686 | A1 * | 7/2008 | Hluchan | B65D 5/38 206/528 |
| 2013/0193822 | A1 * | 8/2013 | Nistor | B65D 11/12 312/296 |
| 2020/0087020 | A1 * | 3/2020 | Tsai | B65D 59/04 |
| 2020/0087021 | A1 * | 3/2020 | Tsai | B65D 50/045 |
| 2020/0146346 | A1 * | 5/2020 | Nelson | B65D 50/046 |
| 2021/0047072 | A1 * | 2/2021 | Ng Pak Leung | B65D 5/4608 |

(Continued)

OTHER PUBLICATIONS

Pet Toy Supplies Cat Scratch Board, Yahoo Taiwan, Retrieve on Oct. 21, 2019, Retrieve from Internet.

(Continued)

*Primary Examiner* — Allan D Stevens

(57) ABSTRACT

A child-proof container includes a casing, a drawer, a folded stopper, a rear brace, a front brace, and an elastic flap. The rear brace is connected across a bottom panel of the casing and positioned offset from a rear panel of the casing. The front brace is connected across the bottom panel and positioned offset from a front opening of the casing. The folded stopper being elastically integrated into a base plate of the drawer thus allowing a first lateral plate and a second lateral plate of the drawer to be slidably engaged within the casing. The elastic flap is integrated into the bottom panel so that the folded stopper can be operatively positioned in between the rear panel and the front brace through the elongated flap to selectively position the drawer in a close-locked position, a close-unlocked position, and an opened position.

11 Claims, 13 Drawing Sheets

(56) References Cited

U.S. PATENT DOCUMENTS

| | | | | |
|---|---|---|---|---|
| 2021/0107712 | A1* | 4/2021 | Chambers | B65D 5/5007 |
| 2021/0354872 | A1* | 11/2021 | Ling | B65D 50/046 |

OTHER PUBLICATIONS

Cat Scratch Board Corrugated Paper, Yahoo Taiwan, Retrieve on Oct. 21, 2019, Retrieve from Internet.

Youthink Store, Cat Scratcher Cardboard, Retrieve on Oct. 21, 2019, Retrieve from Internet <https://www.amazon.com/Collapsible-Scratcher-Recycled-Corrugated-Scratching/dp/B071FZNK8K>.

Hpsgrowlightstore, ScratchMe Cat Scratching Cardboard, Retrieve on Oct. 21, 2019, Retrieve from Internet <https://www.ebay.com/itm/ScratchMe-Cat-Scratching-Cardboard-Cat-Scratcher-Bed-Lounge-and-contains-catnip-/153395473483>.

* cited by examiner

CHILD-PROOF CONTAINER

The current application claims a priority to the U.S. Provisional Patent application Ser. No. 63/110,244 filed on Nov. 5, 2020.

FIELD OF THE INVENTION

The present invention generally relates to a child-proof container. More specifically, the present invention is a drawer type of container with a latch structure that allows the user to lock and unlock by pressing the latch from outside.

BACKGROUND OF THE INVENTION

Child-safety or child-proof feature is a very important field, as there are many items that are potentially hazardous for children, such as medication. Therefore, many issues arise when creating child-proof containers, as the inventor needs to create a container that is hard for children to operate, but not hard enough for adult users to open or close. Even though small and affordable child-proof containers are available to consumers, there is a need for larger child-proof containers that are affordable and not cumbersome.

It is an objective of the present invention provides a solution for all issues mentioned above by providing a drawer-like container with a latch structure. The latch structure allows the present invention to be operated from outside of the container. More specifically, when the user presses an elastic flap that is integrated into the bottom surface of the present invention, the elastic flap activates the latch structure and unlock a drawer-like compartment to store medication or other items that should be stored away from children. When the user placed all items into the storage area, the user just needs to push the drawer-like compartment back into the locked position.

SUMMARY OF THE INVENTION

The present invention is a child-proof container made from paper or other recyclable material. The present invention has a drawer-like structure to store hazardous items away from children, with a latch structure that allows the user to lock and unlock the container from outside to store or remove items from the container.

DETAIL DESCRIPTIONS OF THE INVENTION

Figure 1:
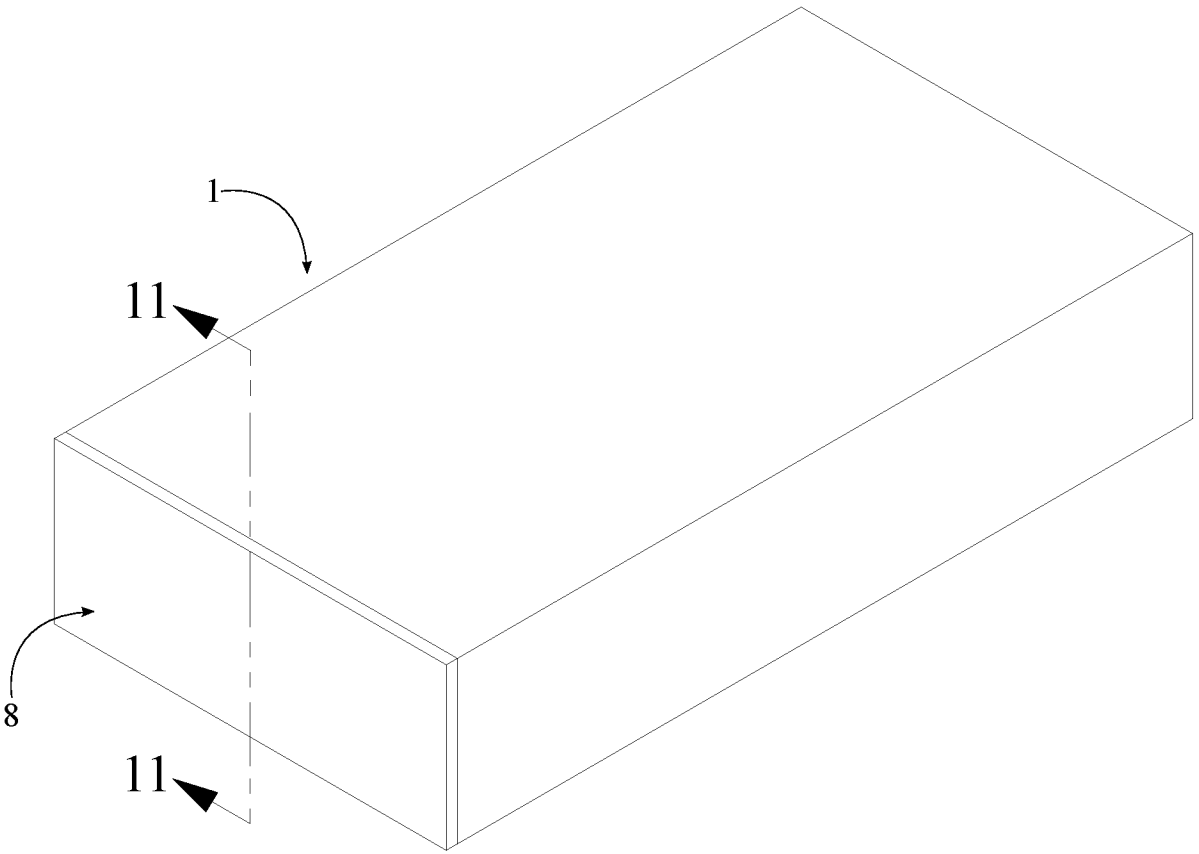
FIG. 1 is a top perspective view of the present invention in the close-locked position.

All illustrations of the drawings are for the purpose of describing selected versions of the present invention and are not intended to limit the scope of the present invention.

The present invention is a child-proof container that comprises a newly designed locking system to prevent children from opening the present invention by accident. The present invention is preferably made from paper or other recyclable material but can be manufactured from different material without deviating from the scope of the present invention. The present invention comprises a casing 1, a drawer 8, a folded stopper 17, a rear brace 22, a front brace 23, and an elastic flap 24 as shown in FIG. 1-5.

Figure 2:
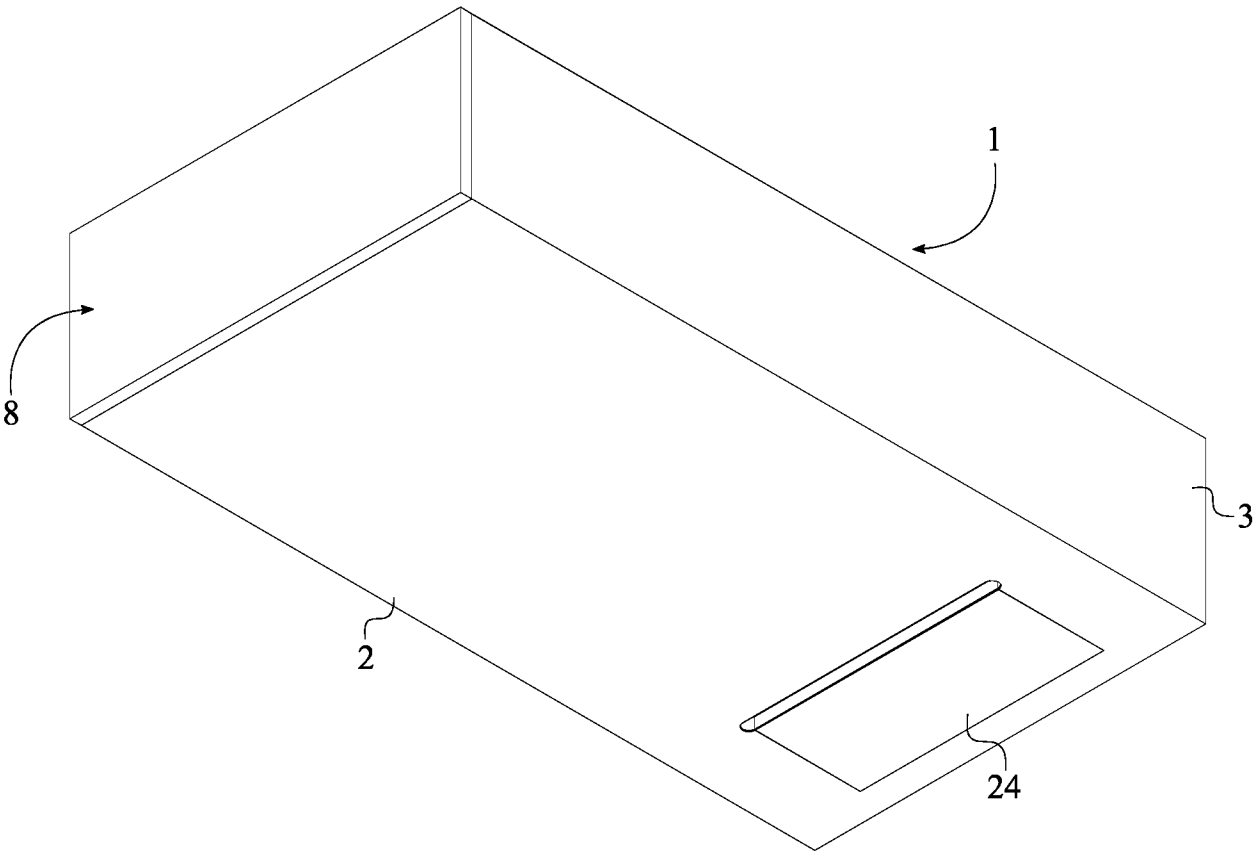
FIG. 2 is a bottom perspective view of the present invention in the close-locked position.
Figure 3:
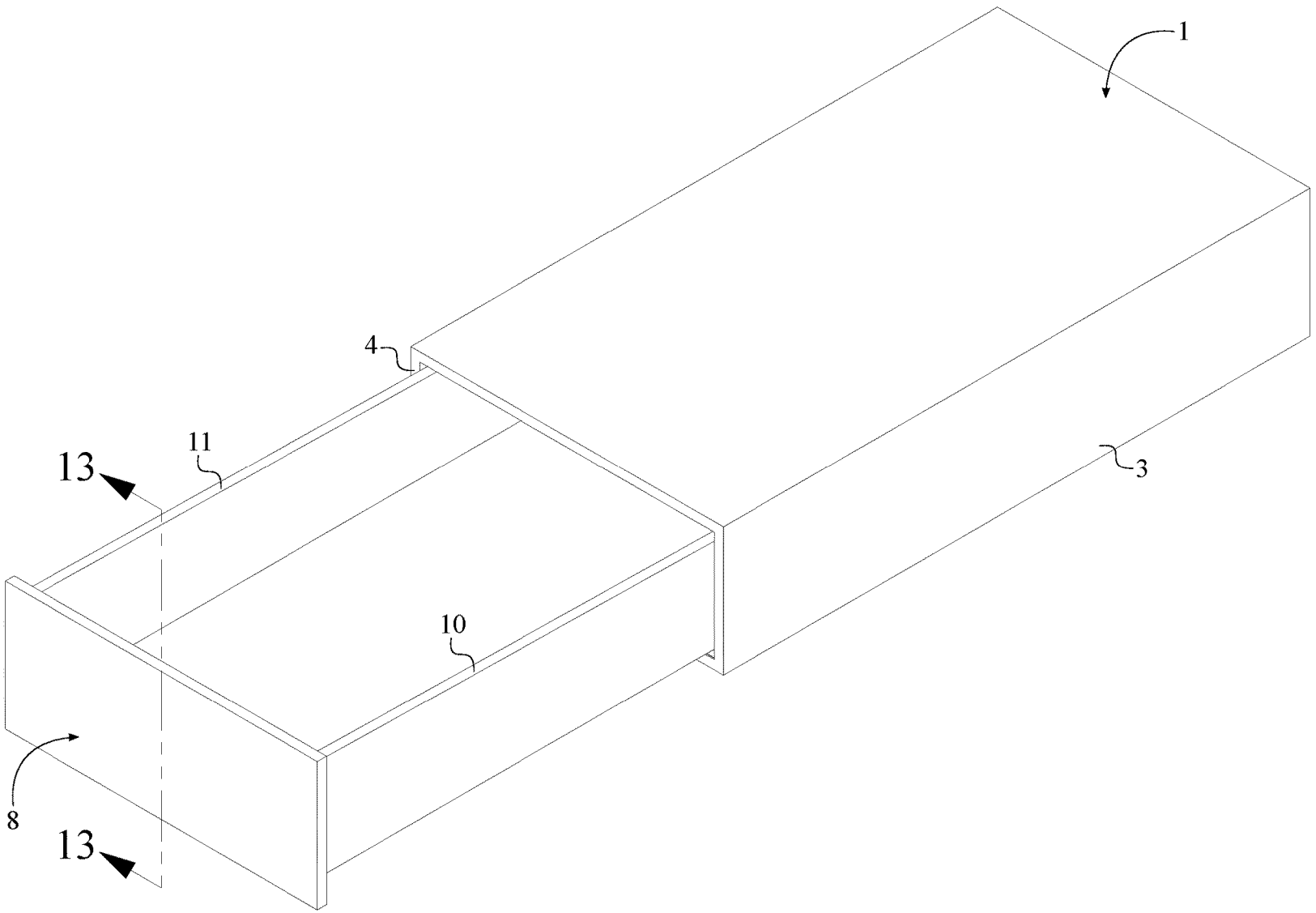
FIG. 3 is a top perspective view of the present invention in the opened position.

In reference to the general configuration of the present invention, as shown in FIG. 1-3, the rear brace 22 is connected across a bottom panel 2 of the casing 1 and positioned offset from a rear panel 6 of the casing 1. The front brace 23 is connected across the bottom panel 2 and positioned offset from a front opening 7 of the casing 1. The rear brace 22 and the front brace 23 function as obstructions so that the back and forth movement of the drawer 8 can be controlled. In other words, the rear brace 22 functions as a locking barriers so that the drawer 8 can be locked within the casing 1. The front brace 23 functions as a stopping barrier so that the drawer 8 does not completely slide out of the casing 1. The folded stopper 17 is elastically integrated into a base plate 16 of the drawer 8 as a first lateral plate 10 and a second lateral plate 11 of the drawer 8 are slidably engaged within the casing 1. More specifically, the first lateral plate 10 and the second lateral plate 11 are slidably positioned atop the front brace 23 and the rear brace 22 so that the drawer 8 can be opened and closed. The elastic flap 24 is integrated into the bottom panel 2 so that the user can easily apply upward pressure to change a natural state of the folded stopper 17 into a compressed state of the folded stopper 17. Once the upward pressure of the elastic flap 24 is released, the compressed state of the folded stopper 17 changes back to the natural state of the folded stopper 17. As a result, the folded stopper 17 is operatively positioned in between the rear panel 6 and the front brace 23 via the elastic flap 24 wherein a selective positioning of the folded stopper 17 configures the drawer 8 in a close-locked position, a close-unlocked position, and an opened position.

The casing 1 is the outer structure of the present invention so that the stored items can be hidden and protected. In reference to FIG. 4-5, the casing 1 further comprises a first side panel 3, a second side panel 4, and a top panel 5 in addition to the bottom panel 2, the rear panel 6, and the front opening 7. The bottom panel 2, the first side panel 3, the top panel 5, and the second side panel 4 are perimetrically connected around the rear panel 6 in order to form the general shape of the casing 1. Furthermore, the length of the bottom panel 2, the first side panel 3, the top panel 5, and the second side panel 4 are equal to each other thus forming a rectangular shape casing 1. The front opening 7 is delineated by the bottom panel 2, the first side panel 3, the top panel 5, and the second side panel 4 in such a way that the front opening 7 and the rear panel 6 are oppositely positioned of each other about the casing 1. In other words, the front opening 7 allows the drawer 8 to be slide in and out from the casing 1 as the bottom panel 2, the first side panel 3, the top panel 5, the second side panel 4, and the rear panel 6 completely covers and protects any stored items within the drawer 8.

Figure 4:
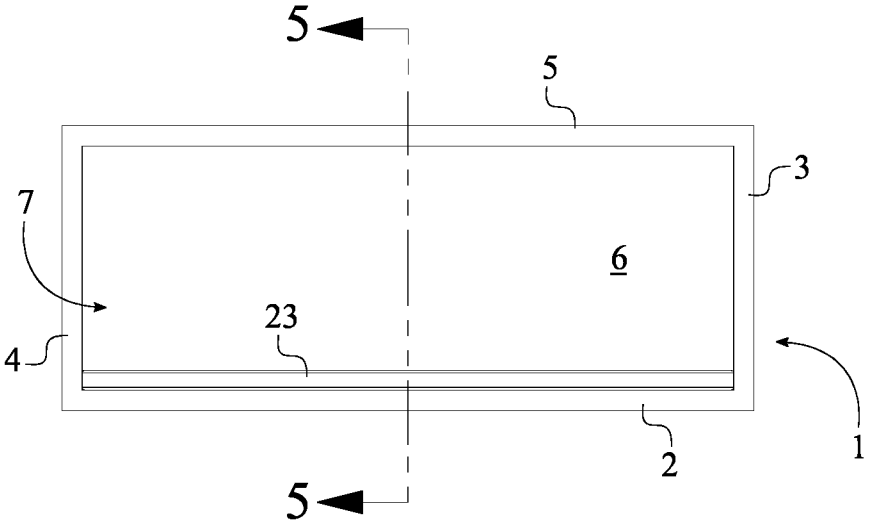
FIG. 4 is a front view of the casing of the present invention, showing the plane upon which a cross sectional view is taken shown in FIG. 5.
Figure 5:
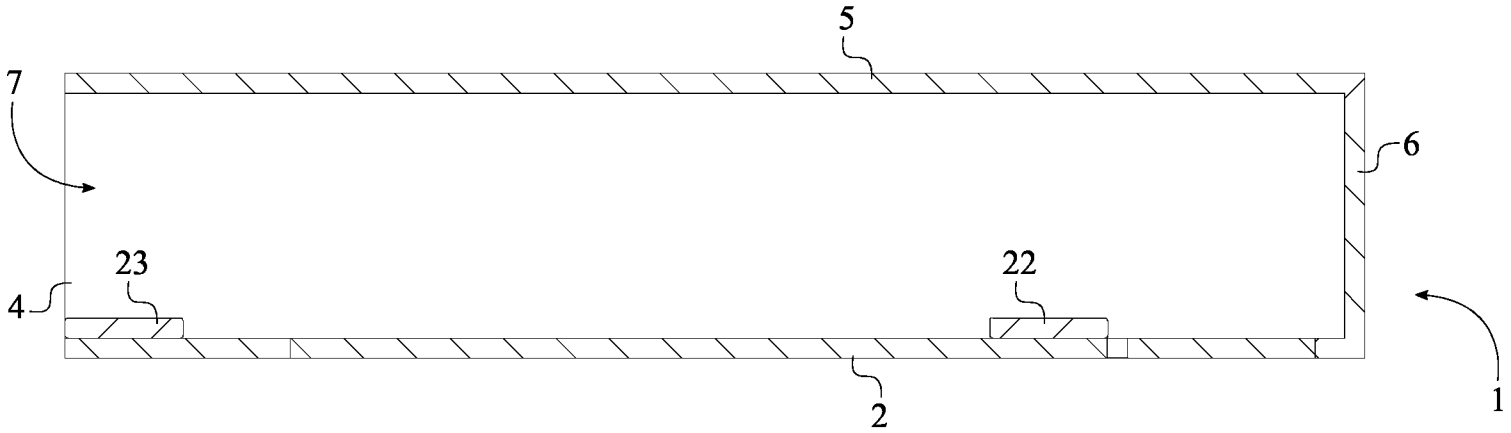
FIG. 5 is a cross section view of the casing of the present invention taken along line 5-5 of FIG. 4.

In reference to FIG. 4-5, the rear brace 22 is extended from the first side panel 3 to the second side panel 4 and positioned parallel to the rear panel 6. More specifically, the rear brace 22 is a rectangular shaped body that perpendicularly extends from the first side panel 3 to the second side panel 4. The offset positioning of the rear brace 22 and the rear panel 6 allows the present invention to be configured in the close-locked position as the rear brace 22 and the natural state of the folded stopper 17 restricts any movement of the drawer 8. The front brace 23 is extended from the first side panel 3 to the second side panel 4 and positioned parallel to the rear brace 22. More specifically, the front brace 23 is a rectangular shaped body that perpendicularly extends from the first side panel 3 to the second side panel 4. The offset positioning of the front brace 23 and the front opening 7 allows the present invention to be configured in the opened position as the front brace 23 and the natural state of the folded stopper 17 prevents the drawer 8 from falling out through the front opening 7.

Figure 6:
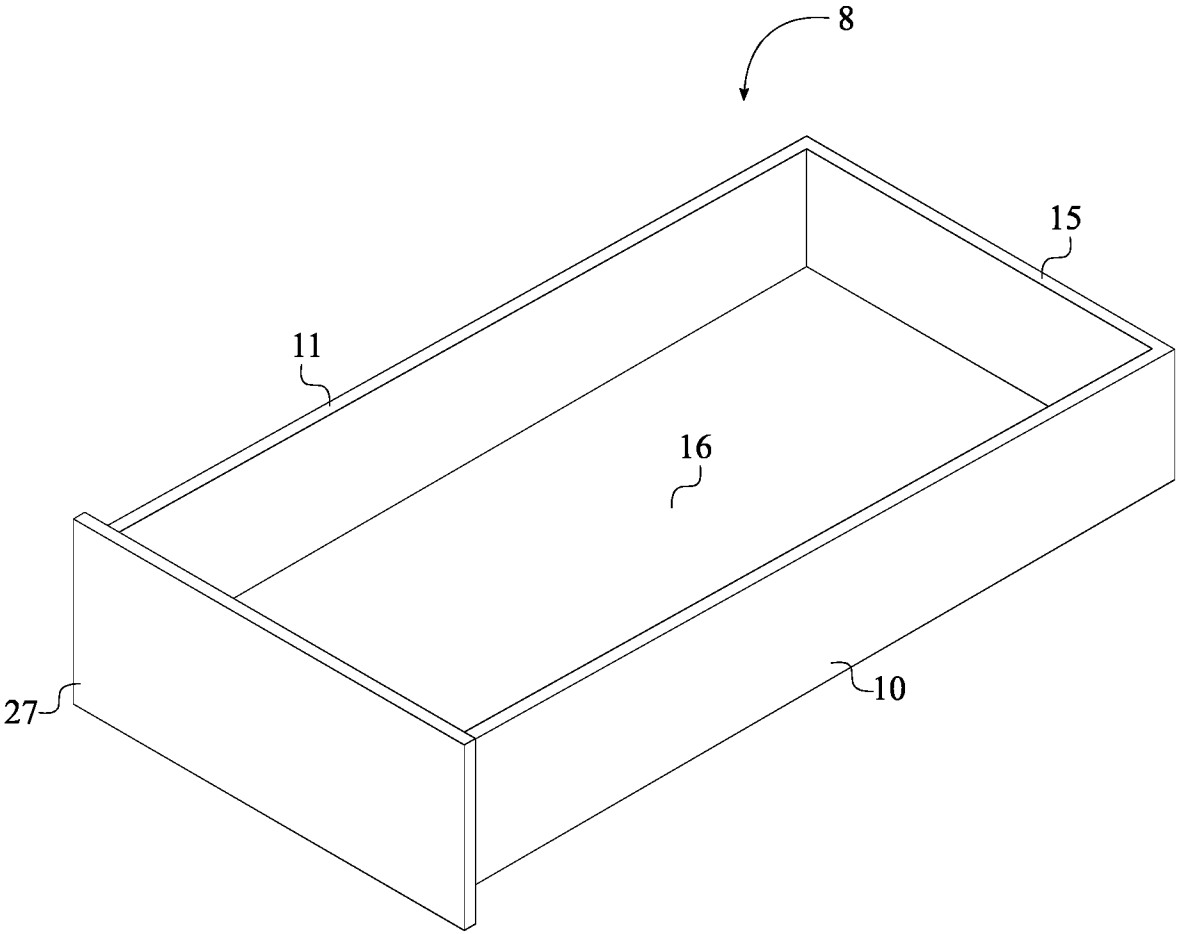
FIG. 6 is a top perspective view of the drawer of the present invention.

The drawer 8 functions as the storage cabinet within the present invention so that items can be securely stored with the drawer 8. The drawer 8 is shaped similar to traditional cabinet drawer 8 with slight modifications so that the present invention can be child-proof. In reference to FIG. 6-8, the drawer 8 further comprising a front plate 9 and a rear plate 15 in addition to the first lateral plate 10, the second lateral plate 11, and the base plate 16. The first lateral plate 10 and the second lateral plate 11 are positioned parallel to each other about the base plate 16, wherein the first lateral plate 10 and the second lateral plate 11 create lateral storage depth to the drawer 8. More specifically, the first lateral plate 10 is perpendicularly connected to the base plate 16. The second lateral plate 11 is perpendicularly connected to the base plate 16, opposite of the first lateral plate 10. The rear plate 15 is perpendicularly positioned to the first lateral plate 10, the second lateral plate 11, and the base plate 16 so that the rear plate 15 can create rear storage depth to the drawer 8. As a result, the rear plate 15 is perimetrically connected to the first lateral plate 10, the second lateral plate 11, and the base plate 16. The front plate 9 and the rear plate 15 are oppositely positioned of each other about the base plate 16 so that the front plate 9 can create the front storage depth to the drawer 8. As a result, the front plate 9 is perimetrically connected to the first lateral plate 10, the second lateral plate 11, and the base plate 16.

Figure 7:
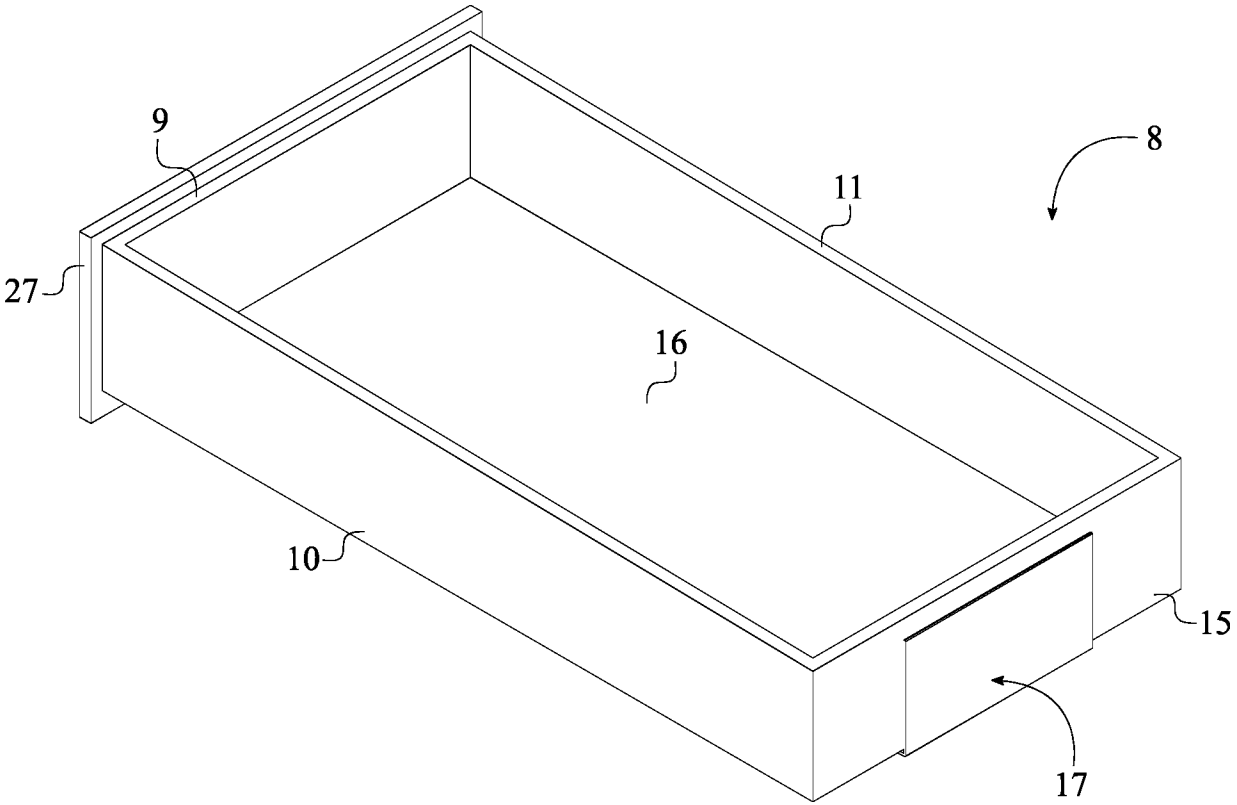
FIG. 7 is another top perspective view of the drawer of the present invention.
Figure 8:
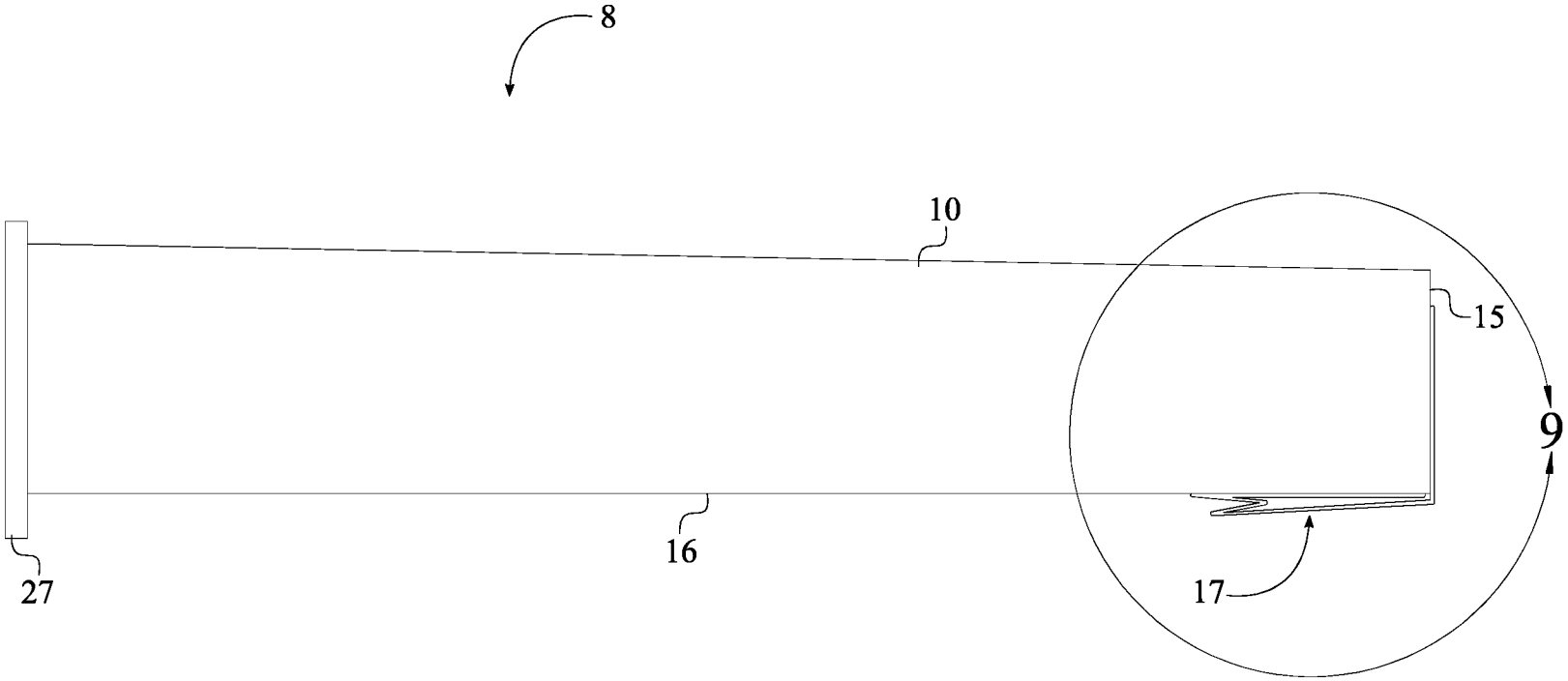
FIG. 8 is a side view of the drawer of the present invention which a detailed view is taken shown in FIG. 9.

The present invention further comprises a face plate 27 that allows the drawer 8 to be closed flush with the casing 1. The face plate 27 is concentrically connected to the front plate 9 and externally positioned to the drawer 8 as shown in FIG. 7. For example, when the present invention is at the close-locked position, the face plate 27 is positioned flush with the bottom panel 2, the first side panel 3, the top panel 5, and the second side panel 4.

Figure 10:
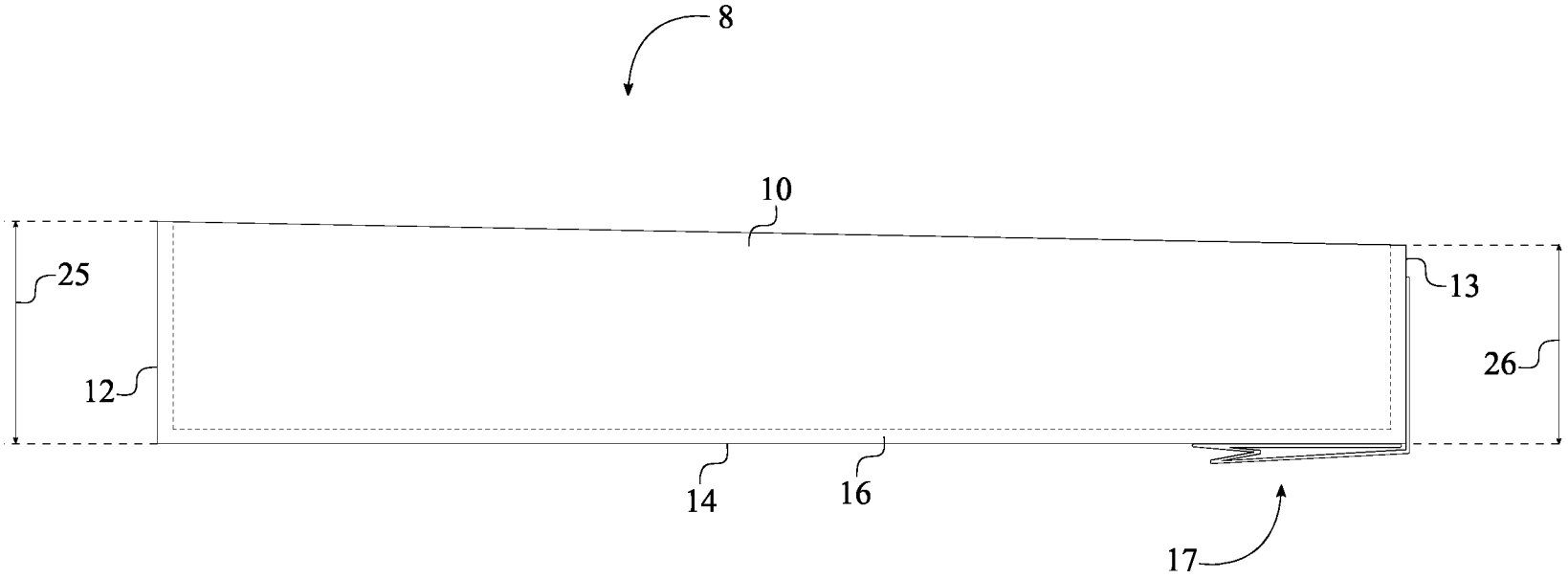
FIG. 10 is a side view of the drawer of the present invention showing the front drawer height and the rear drawer height.

In reference to FIG. 10, the present invention further comprises a front drawer height 25 and a rear drawer height 26. More specifically, the front drawer height 25 is delineated by a front edge 12 of the first lateral plate 10 and the second lateral plate 11 as the front edge 12 is perpendicularly positioned to the base plate 16. The rear drawer height 26 is delineated by a rear edge 13 of the first lateral plate 10 and the second lateral plate 11 as the rear edge 13 is perpendicularly positioned to the base plate 16. In order to facilitate the child-proof functionality of the present invention, the front drawer height 25 is larger than the rear drawer height 26. In other words, a top edge of the first lateral plate 10 and a top edge of the second lateral plate 11 are not parallel to a bottom edge 14 of the first lateral plate 10 and a bottom edge 14 of the second lateral plate 11 in such a way that the top edge descend towards the bottom edge 14 from the front plate 9 to the rear plate 15. This height difference allows the user to lift up the back end of the drawer 8 through the elastic flap 24 and the folded stopper so that the drawer 8 can be configured from the close-locked position to the close-unlocked position before opening.

Figure 9:
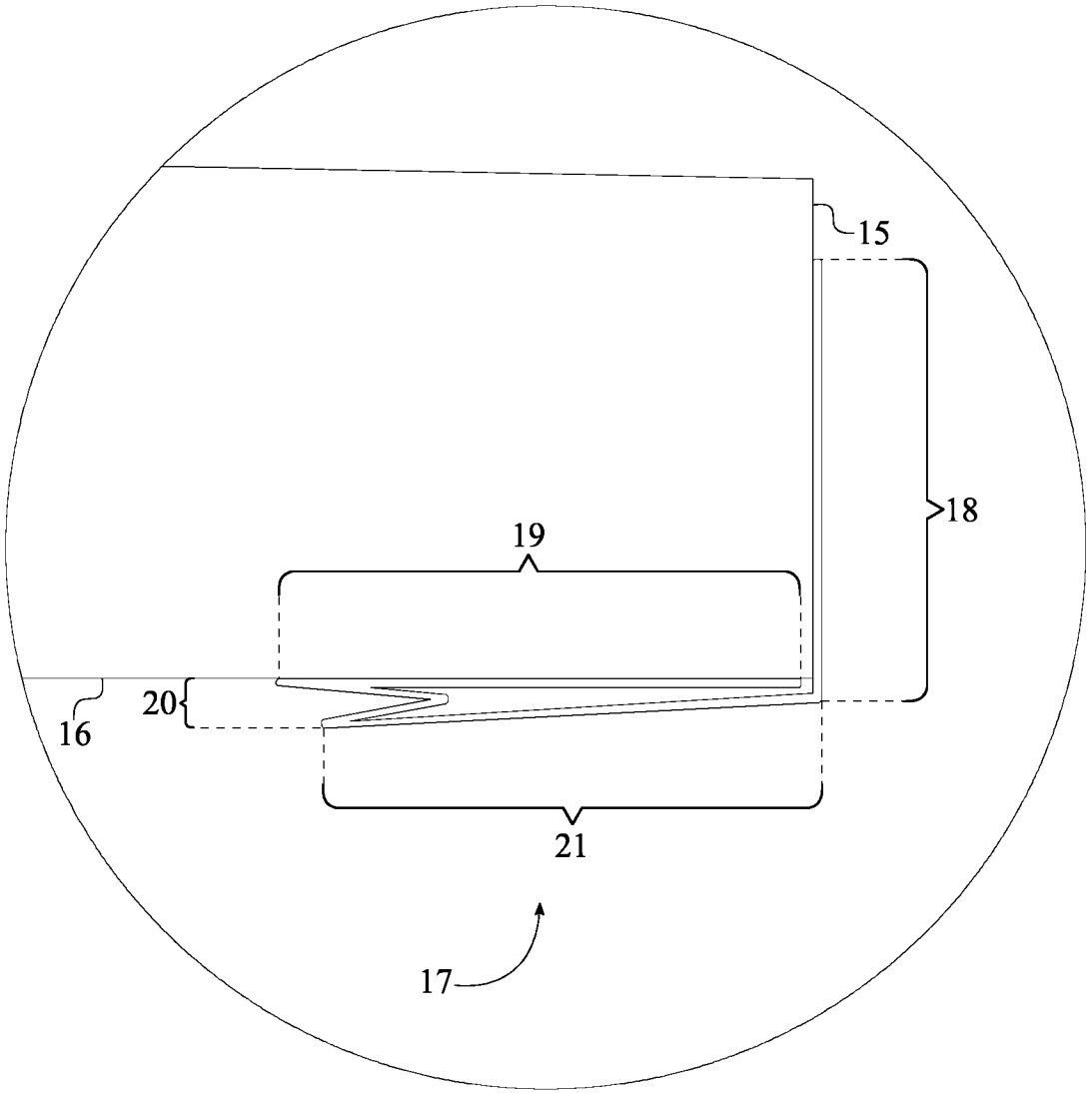
FIG. 9 is a detailed view of the drawer of the present invention showing the configuration of the folded stopper.

The folded stopper 17 functions as the internal mechanism that enable the opening of the drawer 8 or the locking of the drawer 8. In reference to FIG. 9, the folded stopper 17 comprises a first mount 18, a second mount 19, a folded section 20, and a locking section 21. The first mount 18 is terminally connected to the locking section 21. The folded section 20 is terminally connected to the locking section 21, opposite of the first mount 18. The second mount 19 is terminally connected to the folded section 20, opposite of the locking section 21. More specifically, the first mount 18 is laterally connected onto the rear plate 15 of the drawer 8 as the locking section 21 is angularly extended along the base plate 16. The folded section 20 is positioned in between the locking section 21 and the second mount 19 and oriented towards the base plate 16. The second mount 19 is laterally connected onto the base plate 16 and extended towards the first mount 18. As a result, the locking section 21 is positioned below the second mount 19 in such a way that the folded section 20 separates the locking section 21 from the second mount 19. Furthermore, the first mount 18 and the second mount 19 are perpendicularly positioned of each other as the first mount 18 is connected to the rear plate 15 and the second mount 19 is connected to the base plate 16. In other words, the second mount 19, the folded section 20, and the locking section 21 delineate a "M-shaped structure" as the elastic properties are controlled through the folded section 20.

In reference to the slidable engagement between the casing 1 and the drawer 8, the first lateral plate 10 is positioned adjacent to the first side panel 3 and positioned parallel to the first side panel 3. The second lateral plate 11 is positioned adjacent to the second side panel 4 and positioned parallel to the second side panel 4. The rear plate 15 of the drawer 8 is positioned parallel to the rear panel 6. Resultantly, the bottom edge 14 of the first lateral plate 10 and the bottom edge 14 of the second lateral plate 11 are slidably positioned atop the rear brace 22 and the front brace 23 so that the drawer 8 can slidably engaged within the casing 1.

Figure 11:
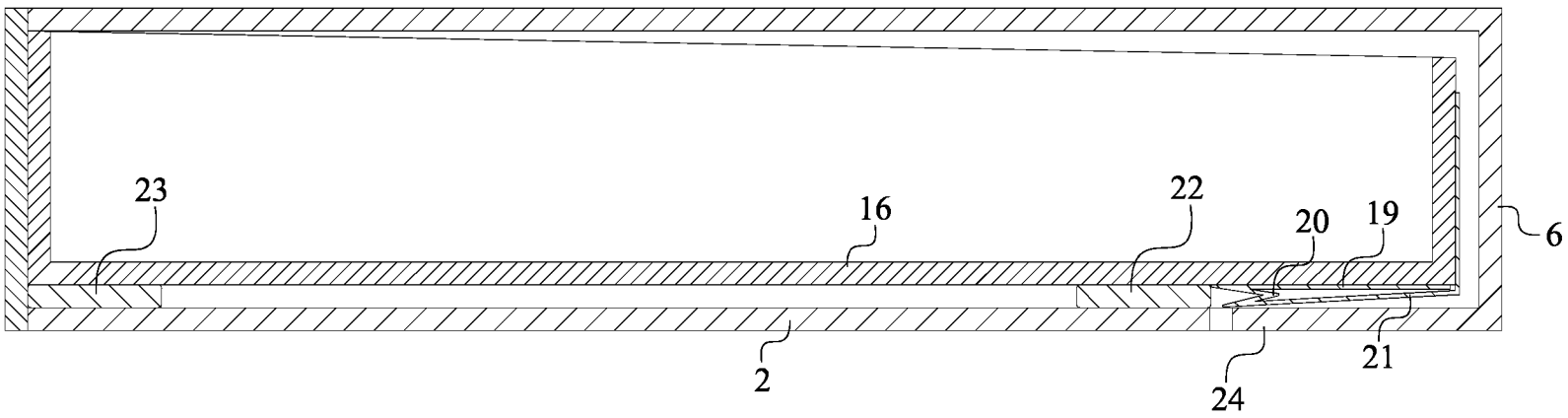
FIG. 11 is a cross section view of the present invention shown within the close-locked position.
Figure 12:
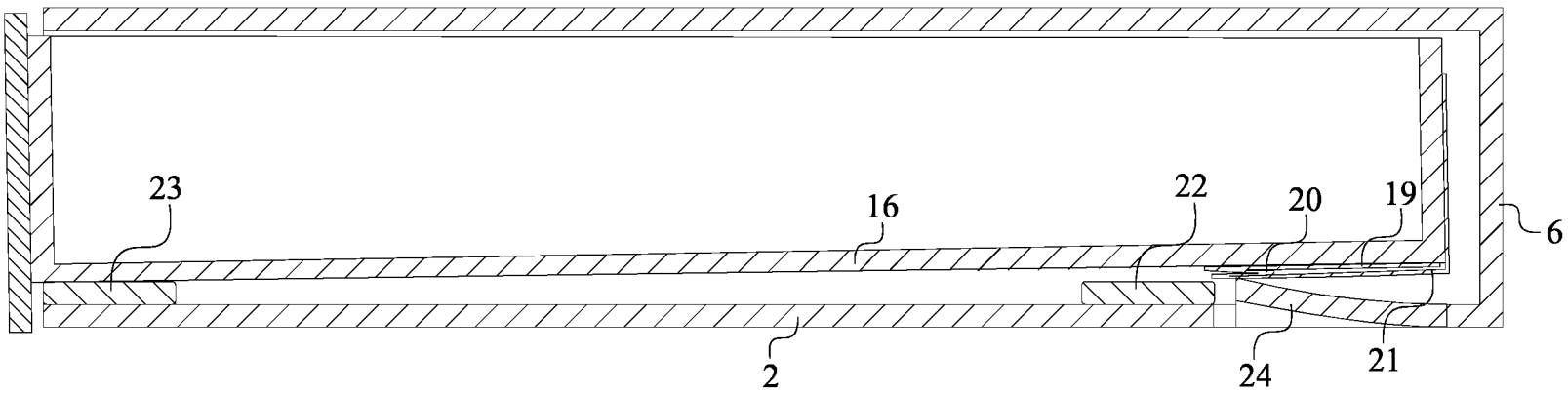
FIG. 12 is a cross section view of the present invention shown within the close-unlocked position.

In reference to FIG. 11-12, the elastic flap 24 is centrally positioned in between the first side panel 3 and the second side panel 4 of the casing 1 and positioned in between the rear panel 6 and the rear brace 22. In other words, the elastic flap 24 provides a designated surface area within the casing 1 so that the user can apply upward pressure to unlock the drawer 8. Furthermore, the shape of the elastic flap 24 can be determined by an elongated cavity that traverses through the bottom panel 2. The elongated cavity is also able to clearly distinguish the elastic flap 24 from the bottom panel 2. When the user apply upward pressure to the elastic flap 24, the elastic flap 24 flexes towards the base plate 16. When applied pressure is released from the elastic flap 24, the elastic flap 24 flexes back into the initial stage. Due to the component configuration of the present invention, the elastic flap 24 flexes towards the folded stopper 17 when the present invention is at the close-locked position so that the deformation of the elastic flap 24 can engaged with the folded stopper 17.

In reference to the close-locked position, as shown in FIG. 11, the elastic flap 24 is positioned parallel to the bottom panel 2. The locking section 21 of the folded stopper 17 is positioned in between the rear panel 6 and the rear brace 22. The locking section 21 and the second mount 19 of the folded stopper 17 are offset of each other. As a result, the folded section 20 of the folded stopper 17 is engaged with the rear brace 22 as the folded section 20 is at the natural state. Furthermore, the base plate 16 is positioned parallel to the bottom panel 2 thus allowing the base plate 16 to be adjacently positioned on the front brace 23 and the rear brace 22. In other words, the drawer 8 does not slide out of the casing 1 as the folded section 20 is engaged behind the rear brace 22.

In reference to the close-unlocked position, as shown in FIG. 12, the elastic flap 24 is offset from the bottom panel 2. The locking section 21 of the folded stopper 17 is positioned in between the rear panel 6 and the rear brace 22. The locking section 21 and the second mount 19 of the folded stopper 17 are positioned adjacent to each other. As a result, the folded section 20 of the folded stopper 17 is positioned offset with the rear brace 22 as the folded section 20 is at the compressed state. Furthermore, the base plate 16 is angularly positioned to the bottom panel 2 thus allowing the base plate 16 to be adjacently positioned on the front brace 23 and positioned offset from the rear brace 22. In other words, the drawer 8 can slide out of the casing 1 as the folded section 20 is not engaged with the rear brace 22.

Figure 13:
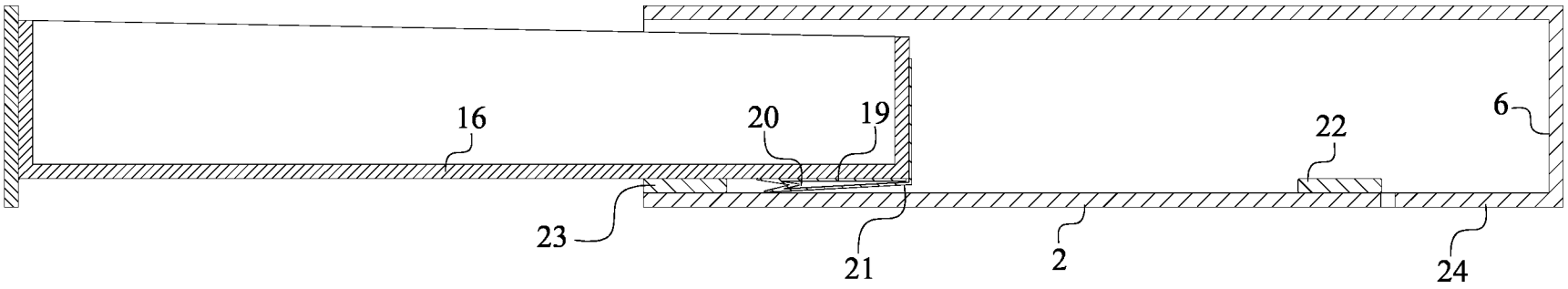
FIG. 13 is a cross section view of the present invention shown within the opened position.

In reference to the opened position, as shown in FIG. 13, the elastic flap 24 is positioned parallel to the bottom panel 2. The locking section 21 of the folded stopper 17 is positioned in between the front brace 23 and the rear brace 22. The locking section 21 and the second mount 19 of the folded stopper 17 are offset of each other. As a result, the folded section 20 of the folded stopper 17 is positioned in between the rear brace 22 and the front brace 23 as the folded section 20 is at the natural state. Furthermore, the base plate 16 is positioned parallel to the bottom panel 2 thus allowing the base plate 16 to be adjacently positioned on the front brace 23. In other words, the drawer 8 fully or partially open from the casing 1 as the folded section 20 glide over the rear brace 22 to be engaged in between the front brace 23 and the rear brace 22. Additionally, when the folded section 20 contacts the front brace 23, the front brace 23 is able to prevent the drawer 8 from completely sliding out of the casing 1.

When the drawer 8 is pushed back into the casing 1, the angular positioning of the locking section 21 glides over the rear brace 22 thus compressing the folded section 20 so that the folded stopper 17 can move pass the rear brace 22 and configured back into the close-unlocked position.

Although the invention has been explained in relation to its preferred embodiment, it is to be understood that many other possible modifications and variations can be made without departing from the spirit and scope of the invention as hereinafter claimed.

What is claimed is:

1. A child-proof container comprising;
a casing;
a drawer;
a folded stopper;
a rear brace;
a front brace;
an elastic flap;
the rear brace being connected across a bottom panel of the casing;
the rear brace being positioned offset from a rear panel of the casing;
the front brace being connected across the bottom panel;
the folded stopper being elastically integrated into a base plate of the drawer;
a first lateral plate and a second lateral plate of the drawer being slidably engaged within the casing;
the elastic flap being integrated into the bottom panel;
the folded stopper being operatively positioned in between the rear panel and the front brace through the elastic flap, wherein a selective positioning of the folded stopper configures the drawer in a close-locked position, a close-unlocked position, and an opened position;
the folded stopper comprising a first mount, a second mount, a folded section, and a locking section;
the first mount being terminally connected to the locking section;
the folded section being terminally connected to the locking section, opposite of the first mount;
the second mount being terminally connected to the folded section, opposite of the locking section;
the first mount being laterally connected onto a rear plate of the drawer;
the second mount being laterally connected onto the base plate;
the locking section being angularly extended along the base plate; and
the folded section being positioned in between the locking section and the second mount.

2. The child-proof container as claimed in claim 1 comprising;
the casing further comprising a first side panel, a second side panel, and a top panel;
the bottom panel, the first side panel, the top panel, and the second side panel being perimetrically connected around the rear panel;
the front opening being delineated by the bottom panel, the first side panel, the top panel, and the second side panel; and
the front opening and the rear panel being oppositely positioned of each other about the casing.

3. The child-proof container as claimed in claim 1 comprising;
the drawer further comprising a front plate and the rear plate;
the first lateral plate and the second lateral plate being positioned parallel to each other about the base plate;
the first lateral plate being perpendicularly connected to the base plate;
the second lateral plate being perpendicularly connected to the base plate, opposite of the first lateral plate;
the rear plate being perpendicularly positioned to the first lateral plate, the second lateral plate, and the base plate;
the rear plate being perimetrically connected to the first lateral plate, the second lateral plate, and the base plate;
the front plate and the rear plate being oppositely positioned of each other about the base plate; and
the front plate being perimetrically connected to the first lateral plate, the second lateral plate, and the base plate.

4. The child-proof container as claimed in claim 3 comprising;

a face plate; and the face plate being connected to the front plate.

5. The child-proof container as claimed in claim 1 comprising;

a front drawer height;

a rear drawer height;

the front drawer height being delineated by a front edge of the first lateral plate and the second lateral plate;

the front edge being perpendicularly positioned to the base plate;

the rear drawer height being delineated by a rear edge of the first lateral plate and the second lateral plate;

the rear edge being perpendicularly positioned to the base plate; and the front drawer height being larger than the rear drawer height.

6. The child-proof container as claimed in claim 1 comprising;

the casing further comprising a first side panel and a second side panel;

the rear brace being extended from the first side panel to the second side panel;

the rear brace being positioned parallel to the rear panel;

the front brace being extended from the first side panel to the second side panel; and the front brace being positioned parallel to the rear brace.

7. The child-proof container as claimed in claim 1 comprising;

the casing further comprising a first side panel and a second side panel;

the first lateral plate being positioned adjacent to the first side panel;

the first lateral plate being positioned parallel to the first side panel;

the second lateral plate being positioned adjacent to the second side panel;

the second lateral plate being positioned parallel to the second side panel;

the rear plate of the drawer being positioned parallel to the rear panel;

a bottom edge of the first lateral plate being slidably positioned atop the rear brace and the front brace; and a bottom edge of the second lateral plate being slidably positioned atop the rear brace and the front brace.

8. The child-proof container as claimed in claim 1 comprising;

the elastic flap being centrally positioned in between a first side panel and a second side panel of the casing; and the elastic flap being positioned in between the rear panel and the rear brace.

9. The child-proof container as claimed in claim 1 comprising;

the close-locked position;

the elastic flap being positioned parallel to the bottom panel;

the locking section of the folded stopper being positioned in between the rear panel and the rear brace;

the locking section and the second mount of the folded stopper being offset of each other;

the base plate being positioned parallel to the bottom panel;

the base plate being adjacently positioned on the front brace and the rear brace; and the folded section of the folded stopper being engaged with the rear brace, wherein the folded section is at a natural state.

10. The child-proof container as claimed in claim 1 comprising;

the close-unlocked position;

the elastic flap being offset from the bottom panel;

the locking section of the folded stopper being positioned in between the rear panel and the rear brace;

the locking section and the second mount of the folded stopper being positioned adjacent to each other;

the base plate being angularly positioned to the bottom panel;

the base plate being adjacently positioned on the front brace;

the base plate being offset from the rear brace; and the folded section of the folded stopper being offset the rear brace, wherein the folded section is at a compressed state.

11. The child-proof container as claimed in claim 1 comprising;

the opened position;

the elastic flap being positioned parallel to the bottom panel;

the locking section of the folded stopper being positioned in between the front brace and the rear brace;

the locking section and the second mount of the folded stopper being offset of each other;

the base plate being positioned parallel to the bottom panel;

the base plate being adjacently positioned on the front brace; and the folded section of the folded stopper being positioned in between the rear brace and the front brace, wherein the folded section is at a natural state.

* * * * *